US005736658A

United States Patent [19]

Mirchandani et al.

[11] Patent Number: 5,736,658

[45] Date of Patent: Apr. 7, 1998

[54] LOW DENSITY, NONMAGNETIC AND CORROSION RESISTANT CEMENTED CARBIDES

[75] Inventors: Prakash K. Mirchandani, Allison Park, Pa.; Les Kastura, Detroit, Mich.

[73] Assignee: Valenite Inc., Madison Heights, Mich.

[21] Appl. No.: 501,485

[22] Filed: Jul. 12, 1995

Related U.S. Application Data

[63] Continuation-in-part of Ser. No. 315,419, Sep. 30, 1994, abandoned.

[51] Int. Cl.[6] ..... C22C 29/02

[52] U.S. Cl. ..... 75/236; 75/242

[58] Field of Search ..... 75/239, 240, 242, 75/236

[56] References Cited

U.S. PATENT DOCUMENTS

| | | | |
|---|---|---|---|
| Re. 22,166 | 8/1942 | Schwarzkopf | 75/241 |
| Re. 25,815 | 7/1965 | Humeink, Jr. et al. | 75/236 |
| 2,147,329 | 2/1939 | Willey | 75/240 |
| 2,731,710 | 1/1956 | Lucas et al. | 75/242 |
| 3,215,510 | 11/1965 | Kelly et al. | 75/240 |
| 3,552,937 | 1/1971 | Mito et al. | 75/240 |
| 3,746,517 | 7/1973 | Yamaya et al. | 75/241 |
| 3,917,463 | 11/1975 | Doi et al. . | |
| 3,918,138 | 11/1975 | Nemeth et al. | 75/237 |
| 4,046,517 | 9/1977 | Soga | 428/539.9 |
| 4,330,333 | 5/1982 | Gibbs | 75/244 |
| 4,497,660 | 2/1985 | Lindholm | 75/240 |
| 4,650,353 | 3/1987 | Rymas | 400/124 |
| 4,963,183 | 10/1990 | Hong | 75/241 |
| 5,145,506 | 9/1992 | Goldstein et al. . | |
| 5,273,571 | 12/1993 | Mirchandani et al. | 75/242 |
| 5,288,676 | 2/1994 | Shimada et al. | 501/93 |
| 5,358,545 | 10/1994 | Nagro | 75/236 |

*Primary Examiner*—Ngoclan Mai

*Attorney, Agent, or Firm*—Mary K. Cameron

[57] ABSTRACT

A resilient and corrosion and wear resistant component of tooling preferably used in the deep-drawing of aluminum and steel cans is disclosed. The tooling is comprised of a distinctive nickel-bonded cemented carbide having a density less than 13 grams per cubic centimeter, a hardness of at least 88 $R_a$, a minimum transverse rupture strength of 250,000 p.s.i. and exhibiting essentially non-magnetic behavior. Preferred compositions for the material of the tooling are also given.

22 Claims, 2 Drawing Sheets

*TRANSVERSE RUPTURE STRENGTH OF EXPERIMENTAL MATERIALS*

Fig-1
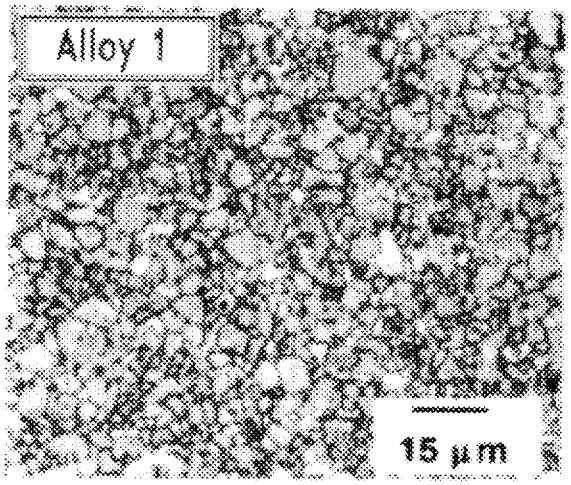
Fig-2
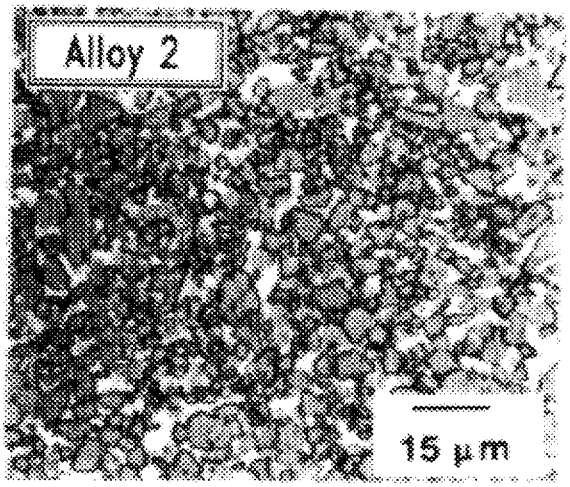
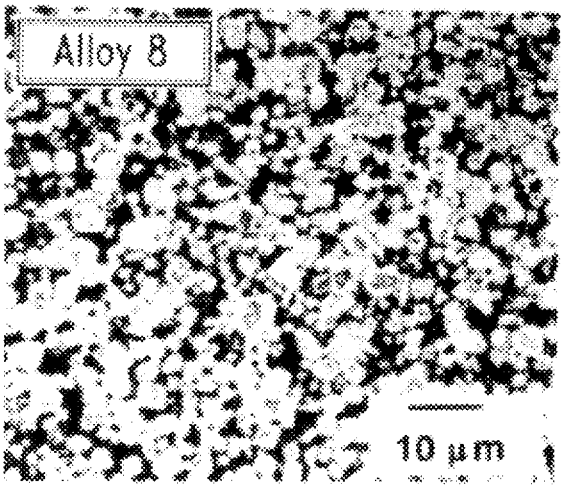
Fig-3
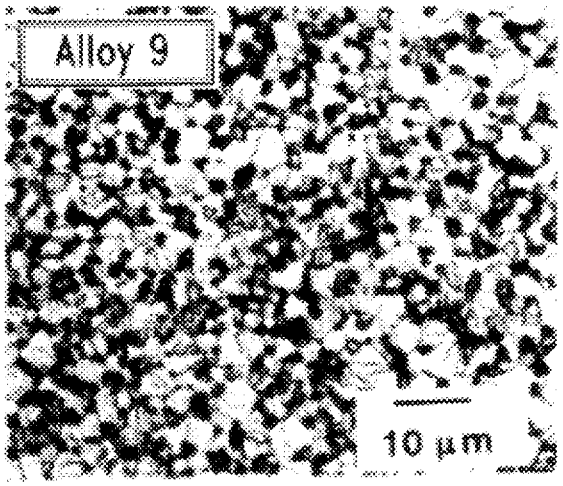
Fig-4

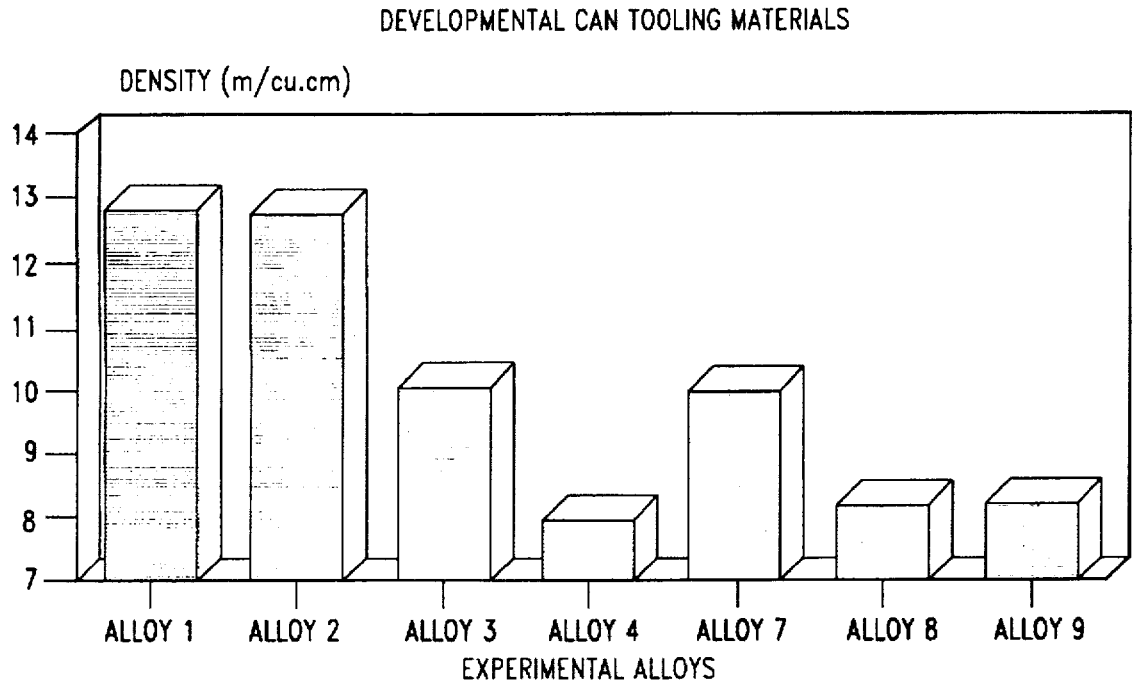
Fig-5 DENSITY OF EXPERIMENTAL ALLOYS
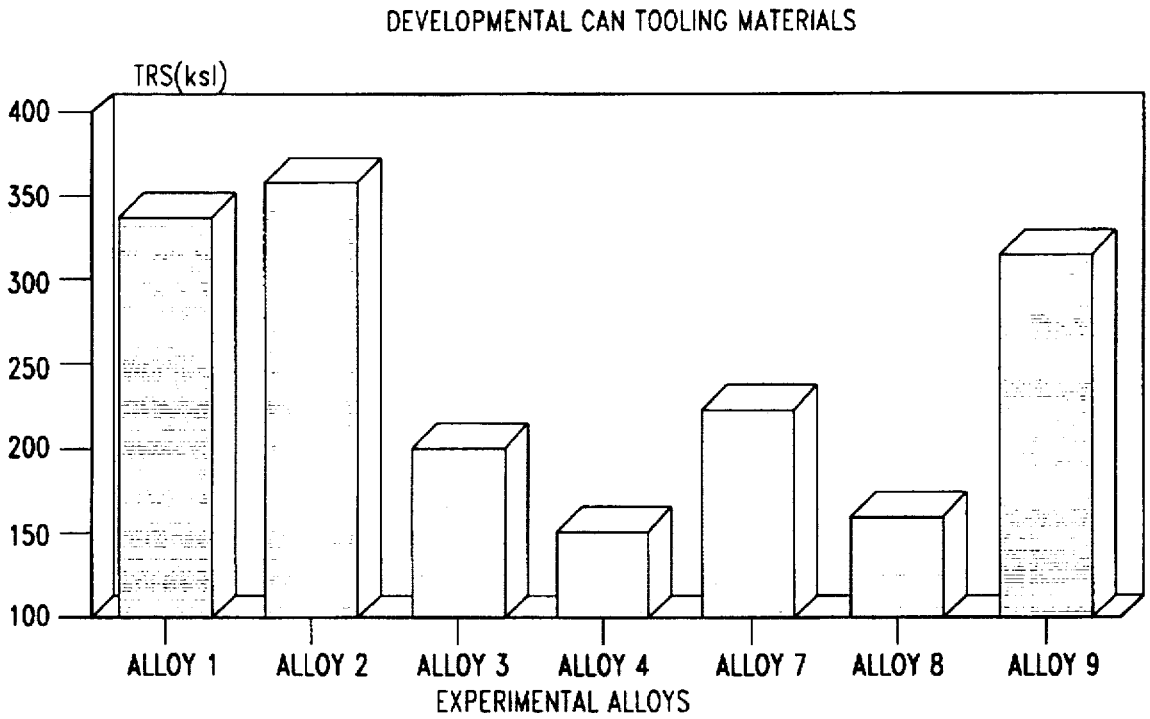
Fig-6 TRANSVERSE RUPTURE STRENGTH OF EXPERIMENTAL MATERIALS

LOW DENSITY, NONMAGNETIC AND CORROSION RESISTANT CEMENTED CARBIDES

This is a continuation-in-part of application Ser. No. 08/315,419 filed on Sep. 30, 1994 now abandoned.

BACKGROUND OF THE INVENTION

1. Field of the Invention

This invention relates generally to cemented carbide materials for high wear uses, particularly, tool and die parts.

2. Description of the Prior Developments

Cemented carbides are finding increasing applications as die and wear parts used for fabricating metal components. An example of such applications is the tooling required in deep-drawing aluminum and steel cans for the beverage industry, for example, components such as bodymaker punches, redraw and ironing rings, necking and cupping dies, and the like. Manufacturers of aluminum and steel beverage cans have found tool steels less preferable compared to nickel-bonded cemented carbides as the material of choice in meeting can tooling requirements of corrosion resistance, wear resistance and toughness.

An additional requirement for can tooling is a relatively low density (comparable to tool steels), allowing efficient operation of deep-drawing presses, by reducing the electrical power usage.

Also, for some tooling applications, for example, bodymaker punches, a further requirement has been recognized by the present inventors, that is, the punch material needs to exhibit consistent and uniform magnetic properties, permitting consistent operation of the electronic sensors used to detect the presence of aluminum and steel cans on the punches during the drawing operation.

Co-bonded cemented carbides are available from Valenite Corporation, Madison Heights, Mich., for example, Valenite grade "VC 11" having a composition of 12Co-WC bal., which have also been proposed for can-tooling operations; however, these are susceptible to attack from the coolants used in deep-drawing operations.

On the other hand, nickel-bonded cemented carbides have been proposed having good wear resistance, corrosion resistance, and toughness. However, such commercially available nickel-bonded cemented carbides suffer from two deficiencies which have prevented their widespread usage for deep drawing applications. These deficiencies are: (i) the density of commercially available nickel-bonded cemented carbides is very high (typically in the 13–15 g/cm3 range), and (ii) the magnetic properties of nickel-bonded cemented carbides are difficult to control within tight ranges and can fluctuate during the drawing operation.

Ni-bonded cemented carbides, for example, Valenite grade VC320 having a composition 12Ni-WC bal., available from Valenite Corporation, Troy, Mich., have been proposed due to their resistance to corrosion compared to Co-bonded cemented carbides. Recently, however, it has been discovered that the use of Ni-bonded cemented carbide tooling for deep drawing applications tends to interfere with the functioning of electronic sensors which are employed to detect the presence of aluminum or steel cans stuck on can punches during deep drawing. These sensors often exhibit erratic behavior which, it is believed, results from variability in the magnetic properties of the Ni-bonded can punches. Moreover, it is believed there exists variability from punch to punch as well as throughout the length of the punch. A particular shortcoming that has been found is the failure of the sensors to sense an aluminum or steel can on the end of the punch after the operation had been in progress for some time.

U.S. Pat. No. 4,963,183 to Hong, assigned to the assignee of the present application, rather broadly discloses a corrosion-resistant cemented carbide composite having a granular WC phase, a semi-continuous solid solution carbide phase and a continuous metal binder phase. The general description of such a composite still does not contemplate the stringent property requirements for can tooling applications, neither as to the use of such a proposed material for can tooling nor the stated compositional ranges required for these particular applications.

Therefore, a need exists for materials which possess toughness, are lightweight and have controlled magnetic properties making them suitable as tools for deep-drawing operations.

As stated earlier, conventional Co- and Ni-based cemented carbides offer a superior combination of properties compared to competitive materials such as tool steels, cermets, and ceramics. However, the above discussion highlights some of the drawbacks of Co- and Ni-based cemented carbides for the can tooling application. Furthermore, the densities of grades such as VC 11 and VC320 are high (in the range 14.0–14.5 g/cm3). The high density of these materials places limitations on the efficiency and productivity of the machinery employed for deep drawing aluminum and/or steel cans.

SUMMARY OF THE INVENTION AND ADVANTAGES

An improved aluminum or steel can tooling material comprises a resilient and corrosion and wear resistant nickel-bonded cemented carbide. The material has a density less than 13 grams per cubic centimeter and consistently behaves as an essentially non-magnetic material under parameters of use in deep-drawing operations.

An advantage of the invention is a cemented carbide can tooling material which offers an improved combination of the following properties:

1. Wear resistance;
2. Corrosion resistance;
3. Toughness and strength;
4. Lower density (at least a 10% reduction compared to standard can tooling grades); and
5. Magnetic properties which are uniform throughout the length and cross-section of a given tool, and consistent from one tool to the next.

A further advantage of the invention, resulting from tooling which possesses the above-stated qualities, is the enhancement of deep-drawing operations in processes for making aluminum and steel cans.

BRIEF DESCRIPTION OF THE DRAWINGS

The accompanying Drawings, which are incorporated in and constitute a part of this Specification, illustrate the preferred embodiments of the invention and, together with the Description, serve to explain the principles of the invention.

FIG. 1 is a view according to the invention, showing typical microstructures of experimental alloy no. 1 described in Table 1;

FIG. 2 is view of typical microstructures of the experimental alloy no. 2 described in Table 1;

FIG. 3 is a view according to the invention, showing typical microstructures of the experimental alloy no. 8 described in Table 1;

FIG. 4 is a view according to the invention, showing typical microstructures of the experimental alloy no. 9 described in Table 1;

FIG. 5 shows densities of the experimental alloys of the invention; and

FIG. 6 shows transverse rupture strength of the experimental alloys of the invention.

DETAILED DESCRIPTION

References will now be made in detail to several embodiments of the invention, which are illustrated in the accompanying Drawings and described by the working examples.

This invention relates to a range of compositions for nickel-bonded cemented carbides, and to tooling made from such compositions, which provide a material not only with good corrosion resistance, wear resistance, and toughness, but also having a density below 13 g/cm$^3$, and preferably less than 10 g/cm$^3$, while behaving as an essentially nonmagnetic material in use. The composition ranges are as follows.

The total binder content comprises from 10 up to 40%, preferably from 12 up to 25%, by weight of the cemented carbide. The binder further comprises from 5 up to 25% Cr, from 5 up to 25% W and from 2 up to 10% other transition elements belonging to groups IVB, VB, and VIB of the periodic table, and the balance Ni.

Total carbide content comprises from 60 up to 90%, preferably from 75 up to 88%, by weight of the cemented carbide. The carbide phase comprises from 20 up to 80% of a TiC cubic phase, from 20 up to 50% WC, present either as an individual phase or dissolved in the TiC phase, and the balance carbides of V, Cr, Zr, Nb, Mo, Hf, and Ta present either as individual phases or dissolved in the TiC phase.

The inventors have demonstrated that operation of the electronic sensors can be made more consistent if the punch material is nonmagnetic, rather than slightly magnetic as is the case for currently available nickel-bonded cemented carbide punches.

Approach and Objective Physical Properties. This invention concerns a family of can tooling grades made from distinctive materials having improved combinations of properties. The alloy design approach taken is discussed below.

Utilizing known Ni-based materials having magnetic properties thought to be stable and uniform, these were alloyed with Cr and/or Mo to improve the corrosion resistance of Ni and also render it nonmagnetic. Density was lowered through addition of TiC (which has a density of only 4.9 g/cm$^3$). The hardness goal was 88–91 $R_a$ to ensure wear resistance levels approximately equivalent to the aforementioned materials designated as VC 11 and VC 320, used as performance comparison benchmarks. The minimum transverse rupture strength goal was 250,000 p.s.i.. A maximum density goal was set at 13 g/cm$^3$ to give at least a 10% improvement compared to VC 11 and VC 320.

Experimental Alloy Preparation. Work was conducted to determine property ranges of example compositions fabricated according to the techniques below. Details of this work and test results follow.

A series of experimental alloys were prepared keeping the above design considerations in mind. Compositions of selected alloys are shown in Table 1. Sintered samples were prepared using standard cemented carbide processing techniques involving attritor milling of powder blends, powder compaction, and vacuum sintering. In all cases sintering was carried out at 1460° C. for 100 minutes. Cr additions were made in the form of $Cr_3C_2$ while Mo additions were made in the form of $Mo_2C$. It can be expected that the Cr in all alloys is dissolved in the Ni-binder phase. It is not clear at this time what percentage of Mo (in alloy 9) is partitioned to the Ni-binder phase, and how much dissolved in the WC or TiC phase.

Densities, hardness, transverse rupture strength, and magnetic properties of the experimental materials were determined using standard measurement techniques. The corrosion resistance of the materials was determined by immersing samples of the experimental alloys in a common lubricant (Ultrashield 919X) for 48 hours followed by determining the amount of binder leached out during the test.

The hardness and magnetic property data are summarized in Table 2, while the density data are shown in FIG. 5.

The transverse rupture strength data are summarized in FIG. 6 and the corrosion data are summarized in Table 3.

As may be observed, all of the experimental alloys meet the hardness, magnetic property, and density goals. Indeed the densities of alloys 4,8, and 9 are essentially equivalent to those of tool steels. Further, it is reasonable to conclude from the limited corrosion data in Table 3 that all of the alloys resist corrosion as least as well as VC 320 (considered to be the benchmark material).

FIG. 6 shows, however, that all of the alloys do not meet the transverse rupture strength goal. It should be noted that alloys based on Ni-Cr binder, and having low levels of TiC (alloys 1 and 2), easily meet the strength goal. As the TiC level increases, Ni-Cr based alloys (alloys 3,4,7, and 8) exhibit relatively low strength levels, and do not meet the strength goal. However, if the Ni-Cr binder is replaced with a Ni-Cr-Mo binder for alloys containing high levels of TiC (alloy 9), the strength level increases dramatically, and the strength goal is met easily. This is believed due to the presence of Mo, which improved wetting of the TiC phase by the liquid phase during sintering. It has been found, therefore, that at TiC levels below about 10%, Ni-Cr based alloys will exhibit adequate strength. As TiC levels are increased about 10%, the Ni-Cr binder needs to be replaced by a Ni-Cr-Mo binder to acceptably meet the criteria established above. The presence of Mo provides an added advantage by improving the corrosion resistance of Ni under reducing conditions or when the alloys come into contact with HCl, since Cr improves the corrosion resistance of Ni only under oxidizing conditions. Alloys based on Ni-Cr-Mo thus exhibit resistance to a wider variety of corrosive media compared to those based on Ni-Cr alone.

Performance Testing. All of the experimental alloys were tested in regards to their compatibility with the electronic sensors used in deep-drawing. All alloys performed well with the sensors exhibiting a wide sensing range in all cases.

Accordingly, the invention has demonstrated feasibility of fabricating cemented carbides which exhibit a unique combination of low density, stable and uniform magnetic properties, along with good strength, corrosion resistance, and hardness levels equivalent to conventional Co- and Ni-based cemented carbides. It has been shown that density reductions can be obtained by increasing TiC content, while the use of Mo as an alloying agent was successfully employed to obtain the high strength properties required.

It has been discovered that the aforementioned VC 320 is normally "slightly" magnetic, and that the Curie temperature of the Ni-binder in VC 320 is typically in the 50°–200° C. range. Because of this, VC 320 punches can easily fluctuate between magnetic and nonmagnetic behavior even with a relatively small fluctuation in the punch temperature. It is believed that one reason for the erratic behavior of the electronic sensors used for deep-drawing, even after a successful initial setup, is the normal temperature variations encountered in the punch during operation. It is also known that the range or "window" of carbon composition generally tolerable for Ni-based grades is rather narrow. Moreover, the final carbon contents of sintered parts, hence their magnetic properties, are very sensitive to the size and thickness of the part. It is believed these considerations could likely explain the variability from punch-to-punch as well as that observed within each punch for the magnetic behavior of can punches made from such a material as VC 320.

This invention, on the other hand, narrows the composition range and defines materials specifically suitable for can tooling applications. The low density of these materials is a particularly novel feature. Hence it can be expected that the nickel-bonded, nonmagnetic cemented carbides will become increasingly attractive for this application. A lowering of the density to 10 g/cm$^3$, or even lower, further makes nickel-bonded cemented carbides extremely attractive for a variety of can tooling applications.

In contradistinction, no mention is made of low density or nonmagnetic compositions, nor are the compositional ranges of this invention contemplated by those compositional ranges specified in the above U.S. Pat. No. 4,963,183, hence the present invention is believed to be novel.

While the invention has been described with respect to certain embodiments, it will be obvious that various modifications may be contemplated by those skilled in the art without departing from the scope of the invention as defined by the appended claims which follow.

What is claimed is:

1. A nickel-bonded carbide composition comprising: from 10–40% by compositional weight of a binder phase which, in turn, contains from 5–25% Cr, from 5–25% W, from 2–10% selected from other transition elements belonging to groups IVB, VB, VIB of the periodic table and the balance of the binder phase containing Ni; and from 60–90% by compositional weight of a carbide phase which, in turn, contains 20–80% of a TiC cubic phase, from 20–50% WC present either as an individual phase or dissolved in the TiC phase, with the balance of the carbide phase being selected from the group consisting essentially of V, Cr, Zr, Mo, Hf and Ta, present either as individual phases or dissolved in the TiC phase.

2. The invention of claim 1 wherein the binder content further comprises 12–25% by weight of the cemented carbide.

3. The invention of claim 1 wherein the carbide content comprises from 75–88% by weight of the cemented carbide.

4. The invention of claim 3 wherein the carbide content further comprises WC present as an individual phase.

5. The invention of claim 3 wherein WC is dissolved in the TiC cubic phase.

6. The invention of claim 3 wherein the carbides of the group comprising V, Cr, Zr, Nb, Mo, Hf and Ta are present as individual phases.

7. The invention of claim 3 wherein the carbides of the group comprising V, Cr, Zr, Nb, Mo, Hf and Ta are found dissolved in the TiC phase.

8. An improved tooling material comprising a resilient, corrosion and wear resistant nickel-bonded cemented carbide having a density less than 10 grams per cubic centimeter which behaves as an essentially non-magnetic material, wherein the material has a binder content comprising from 10–40% by weight of the cemented carbide and a carbide phase, said carbide phase comprised of 20–50% WC, and the binder further comprises a metal selected from the group consisting of Cr, W and mixtures thereof present in an amount from 5–25% by weight of the binder phase.

9. An improved tooling material comprising a resilient, corrosion and wear resistant nickel-bonded cemented carbide having a density less than 10 grams per cubic centimeter which behaves as an essentially non-magnetic material, wherein the material has a binder content which comprises from 16–24% by weight of the cemented carbide, and a carbide phase, said carbide phase comprised of 20–50% WC.

10. The invention of claim 8 wherein said metal is Cr.

11. The invention of claim 9 further comprising Cr present in an amount from 5–25% by weight of the binder phase.

12. The invention of claim 8 wherein said metal is W.

13. The invention of claim 9 further comprising W present in an amount from 5–25% by weight of the binder phase.

14. A resilient and corrosion resistant component of tooling used in the deep-drawing of aluminum cans, which tooling is comprised of a distinctive nickel-bonded cemented carbide having a density less than 13 grams per cubic centimeter, a hardness of at least 88 $R_a$, a minimum transverse rupture strength of 250,000 p.s.i. and exhibiting essentially non-magnetic behavior, wherein the tooling has a binder content comprising from 16–24% by weight of the cemented carbide.

15. The tooling of claim 14 further comprising a density less than 10 grams per cubic centimeter.

16. The invention of claim 14 further comprising Cr present in an amount from 5–25% by weight of the binder phase.

17. The invention of claim 16 further comprising W present in an amount from 5–25% by weight of the binder phase.

18. The invention of claim 10 wherein the binder content further comprises from 12–25% by weight of the cemented carbide.

19. The invention of claim 12 wherein the binder content further comprises from 12–25% by weight of the cemented carbide.

20. An improved tooling material comprising a resilient, corrosion and wear resistant nickel-bonded cemented carbide having a density less than 10 grams per cubic centimeter which behaves as an essentially non-magnetic material, wherein the material has a binder content comprising from 12–25% by weight of the cemented carbide and the binder comprises Cr present in an amount from 5–25% by weight of the binder phase.

21. An improved tooling material comprising a resilient, corrosion and wear resistant nickel-bonded cemented carbide having a density less than 10 grams per cubic centimeter which behaves as an essentially non-magnetic material, wherein the material has a binder content comprising from 12–25% by weight of the cemented carbide and the binder comprises W present in an amount from 5–25% by weight of the binder phase.

22. A resilient and corrosion and wear resistant component of tooling used in the deep-drawing of aluminum cans, which tooling is comprised of a distinctive nickel-bonded cemented carbide having a density less than 10 grams per cubic centimeter, a hardness of at least 88 $R_a$, a minimum transverse rupture strength of 250,000 p.s.i. and exhibiting essentially non-magnetic behavior, wherein the material has a binder content comprising from 16–24% by weight of the cemented carbide.

* * * * *